US009533497B2

(12) United States Patent
Roof et al.

(10) Patent No.: US 9,533,497 B2
(45) Date of Patent: Jan. 3, 2017

(54) SYSTEMS AND METHODS FOR PRINTING RAISED MARKINGS ON DOCUMENTS

(75) Inventors: Bryan J. Roof, Newark, NY (US); Grace T. Brewington, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 189 days.

(21) Appl. No.: 13/539,533

(22) Filed: Jul. 2, 2012

(65) Prior Publication Data

US 2014/0002520 A1 Jan. 2, 2014

(51) Int. Cl.

| | |
|---|---|
| ***B41J 2/045*** | (2006.01) |
| ***B41J 3/00*** | (2006.01) |
| ***B41J 3/32*** | (2006.01) |

(52) U.S. Cl.

CPC ..... *B41J 2/04573* (2013.01); *B41J 2/04508* (2013.01); *B41J 2/04526* (2013.01); *B41J 2/04556* (2013.01); *B41J 2/04581* (2013.01); *B41J 3/00* (2013.01); *B41J 3/32* (2013.01)

(58) Field of Classification Search

CPC . B41J 2/04573; B41M 5/0047; B29C 67/0059
See application file for complete search history.

(56) References Cited

U.S. PATENT DOCUMENTS

| | | | | |
|---|---|---|---|---|
| 6,796,628 | B2 * | 9/2004 | Miller | B41J 29/393 347/14 |
| 7,925,043 | B2 | 4/2011 | Kazmaier et al. | |
| 2001/0003004 | A1 * | 6/2001 | Leyden et al. | 425/375 |
| 2003/0151167 | A1 * | 8/2003 | Kritchman | B29C 67/0059 264/401 |
| 2003/0179270 | A1 * | 9/2003 | Yamamoto et al. | 347/102 |
| 2004/0090478 | A1 * | 5/2004 | Miller | 347/14 |
| 2006/0158470 | A1 * | 7/2006 | Vanheusden et al. | 347/8 |
| 2007/0019017 | A1 * | 1/2007 | Sussmeier | 347/14 |

(Continued)

FOREIGN PATENT DOCUMENTS

| | | | |
|---|---|---|---|
| EP | 2161137 | A1 * | 3/2010 |
| JP | 10230595 | A * | 9/1998 |
| WO | WO 2009156993 | A2 * | 12/2009 |

OTHER PUBLICATIONS

Grace T. Brewington; U.S. Appl. No. 13/410,974, filed Mar. 2, 2012.

Bryan J. Roof; U.S. Appl. No. 13/411,038, filed Mar. 2, 2012.

*Primary Examiner* — Shelby Fidler

(74) *Attorney, Agent, or Firm* — Ronald E. Prass, Jr.; Prass LLP

(57) ABSTRACT

Systems for forming three-dimensional marking material images on moving substrates include a print head arranged about a media path by which the substrate passes the print head at a predetermined media velocity. The jets marking material at a predetermined velocity onto the substrate surface to form a three-dimensional marking material image. A firing time of forming a first layer of marking material may be different with respect to a print run start time than a firing time for ejecting marking material for forming successive layers. The firing time may be adjusted by advancing or delaying the firing time with respect to an initial firing time for forming the first layer. The advance or delay may be calculated by a processor, and the calculation may be fed to a time advance/delay buffer contained by the print head.

16 Claims, 4 Drawing Sheets

(56) References Cited

U.S. PATENT DOCUMENTS

| | | | | |
|---|---|---|---|---|
| 2008/0151310 | A1* | 6/2008 | Kazmaier | B41M 3/14 358/3.28 |
| 2009/0073209 | A1* | 3/2009 | Uno | 347/12 |
| 2010/0055407 | A1 | 3/2010 | Belelie et al. | |
| 2010/0055415 | A1 | 3/2010 | Belelie et al. | |
| 2010/0055423 | A1 | 3/2010 | Chretien et al. | |
| 2010/0055484 | A1 | 3/2010 | Chretien et al. | |

* cited by examiner

SYSTEMS AND METHODS FOR PRINTING RAISED MARKINGS ON DOCUMENTS

RELATED APPLICATIONS

This application is related to U.S. patent application Ser. No. 13/410,974 entitled "Systems and Methods for Printing Hybrid Raised Markings On Documents To Enhance Security" and U.S. patent application Ser. No. 13/411,038 entitled "Systems And Methods For Forming Raised Markings On Substrates For Braille Identification And Security And To Facilitate Automatic Handling Of The Substrates," which are co-owned with this application, and the disclosures of which is hereby incorporated by reference herein in its entirety.

FIELD OF DISCLOSURE

The disclosure relates to systems and methods for printing raised markings on documents. In particular, the disclosure relates to systems and methods for applying raised markings on documents such as paper currency to provide enhanced security and/or provide recognition of documents for the visually impaired.

BACKGROUND

Related art printing systems and methods produce documents having raised markings formed by applying ink layer by layer to increase an ink pile height as a substrate or media such as a paper web passes a print head.

SUMMARY

Producing three dimensional structures on moving media is useful for printing lenticular structures, Braille, two dimensional bar codes, security encoding on currency, etc. Any piezo or similar drop ejection device such as a microelectro mechanical system may be implemented in accordance with embodiments disposed herein. The drop ejection device may be a print head configured for forming three dimensional structures on media using jetted inks or epoxies.

One issue confronted by forming three dimensional structures on moving media is that as a height of the ink image grows, either by multiple passes of media under the print head or by passing under multiple print heads, the media along a media path, a gap or distance between the ink image on the media and the print head becomes considerably smaller. For example, if printing a gel ink on media using a system wherein media passes the same print head many times, a first layer is ejected onto a surface of the media at a location that is further away from the print head than, for example, a fortieth layer, which is roughly 400 microns in total thickness using gel ink. Because the ink ejection velocity from the print head until placement on the paper is substantially constant, a time of flight of ink ejected to form a first layer is longer than a time of flight of ink ejected to form the last layer of the ink image. This position error in drop placement may be objectionable in the final image.

Systems and methods for time of flight correction for forming three dimensional ink structures on moving media are provided. In an embodiment, systems for controlling printing of raised markings on a substrate may include at least one ink ejecting device configured to eject ink onto a surface of a substrate moving at a predetermined velocity, wherein a first layer of ink is formed at a target location on the substrate surface by ink ejected by the ink ejecting device at a first firing time, and wherein a second layer of ink is formed at the target location by ink ejected by the ink ejecting device at a second firing time. The ink ejection device may comprise an inkjet print head having one or more jets. The ink ejection device may comprise any piezo, or similar drop ejection device such as a micro electromechanical system. The print head may include at least one ink jet. Alternatively, systems may include a plurality of ink ejecting devices arranged about a media path and configured to eject ink onto surface of a passing substrate such as paper or other suitable media. Although disclosed embodiments configured for printing gel ink are provided, systems and methods may be adapted and configured for printing with other marking materials, including marking materials comprising acrylates, epoxies, and/or resins.

A firing time may be a time at which ink is ejected onto the substrate at a point during a time period during which the substrate passes the ink ejecting device, or a print run start time. A firing time may be an elapsed time after detection of, for example, a lead edge of a sheet on which the ink is to be deposited. Systems may be configured whereby the second layer is formed on the first layer, at the target location on the substrate surface. The second layer may be formed at a distance from the print head that is less than the distance between the print head and the first layer. The ink ejection device may be configured to form the first layer, the second layer, and successive layers by ejecting ink at a respective firing time that is based on at least one of the thickness of the layer previously formed at the location, and a number of ink layers previously ejected onto the surface at the location on the substrate.

In an embodiment, systems may include the at least one ink ejecting device comprising a first print head and a second print head, wherein the first print head forms the first layer and the second print head forms the second layer at the target location on the substrate. Systems may include a recirculating media transport system configured to cause a substrate to pass at least one print ejecting device at a predetermined velocity. The at least one ink ejecting device may be connected to a controller, the controller being configured to cause the at least one ink ejecting device to form at least a first layer and a second layer at the location. The controller may be a processor that may be caused to calculate a firing time based on a media speed, ink jet velocity, a layer thickness, and a number of layers previously formed at the location.

The at least one ink ejection device may be configured to include a time advance/delay buffer. The time advance/delay buffer may be configured to receive a firing time value, or a firing time advance or delay value, calculated by a processor configured to calculate the firing time value based on at least one of a layer thickness, an ink ejection velocity, a media velocity, and a number of layers previously applied to the location on the substrate surface. The value may be used to cause a jet or plurality of jets to fire at a predetermined or adjusted time, with respect to a print run start time, for example. The firing time may be an elapsed time after a start of a print run. The firing time may be an elapsed time after a detection of a lead edge of a sheet on which marking material is deposited.

In an embodiment, methods for printing raised markings on a substrate may include causing a print head to eject ink onto a surface of the substrate at a target location to form a first ink layer at the target location, the ink being ejected at a first firing time; and causing one of the print head or a second print head to eject ink onto the surface of the substrate at the target location to form a second ink layer at the target location, the ink being ejected at a second firing time. The second layer may be formed on the first layer. The second firing time may be based on a time delayed value received by a time delay buffer at the print head.

Methods may include calculating, with a processor, the time delay value based on at least one of a layer thickness, a media velocity, a jet velocity, and a number of ink layers previously applied to the surface of the substrate at the target location. The calculated time delay value may be fed to a time delay buffer included in the print head.

Methods may include the firing time being a time at which the print head ejects ink with respect to a predetermined time, such as a print run start time, or preferably, a time of detection of a lead edge of a sheet. Time delay may be calculated based on a predetermined media velocity, a predetermined jet velocity, a predetermined layer thickness, and a number of layers, the number of layers being a number of layers previously applied to the target location of the surface of the substrate. Methods may include changing the value of the predetermined layer thickness for adjusting drop placement correction.

Exemplary embodiments are described herein. It is envisioned, however, that any system that incorporates features of apparatus, systems, and methods described herein are encompassed by the scope and spirit of the exemplary embodiments.

Exemplary embodiments are described herein. It is envisioned, however, that any system that incorporates features of apparatus, systems, and methods described herein are encompassed by the scope and spirit of the exemplary embodiments.

DETAILED DESCRIPTION

Figure 1:
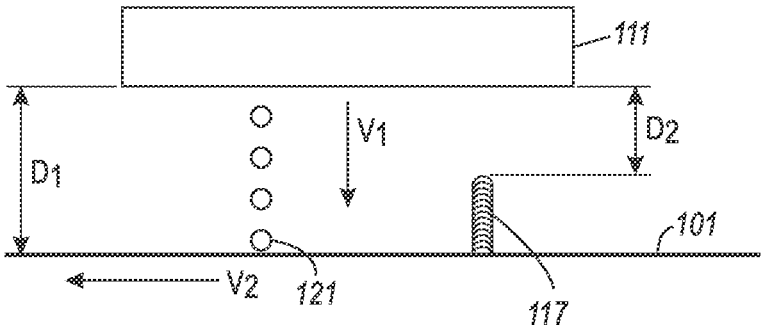
FIG. 1 shows a diagrammatical view of a system for printing raised markings on a substrate.

Exemplary embodiments are intended to cover all alternatives, modifications, and equivalents as may be included within the spirit and scope of the apparatus and systems as described herein.

Reference is made to the drawings to accommodate understanding of systems for forming raised markings on moving media. In the drawings, like reference numerals are used throughout to designate similar or identical elements. The drawings depict various embodiments related to embodiments of illustrative apparatus, systems, and methods for printing three-dimensional ink structures on moving media.

A piezo or similar drop ejection device such as a microelectro mechanical system may be implemented for forming three dimensional structures comprising marking material such as ink on moving media such as paper sheet or other substrate. In particular, raised markings may be formed by ejecting ink in multiple layers on a same location of a substrate. Ink such as gel ink is discussed by way of example; systems and methods may be advantageously adapted and configured for printing with other marking materials including those comprising acrylate, epoxies and/or resins. An issue confronted with forming structured, e.g., ink images is that as a height of the ink image grows, either by multiple passes under a print head or by passing under multiple print heads the ink image, the gap between the print head and image becomes considerably smaller. For example, when printing a gel ink on media wherein media passes a same print head a plurality of times, a first layer is deposited on a surface of the media or substrate at a constant jet velocity and at a location that is further away from the print head than a subsequent layer such as a fortieth layer. Each layer may be, for example, about 10 microns, a forty layer structure being about 400 microns in total thickness. As a result, because an ejection velocity of ink ejected by a print head is constant, a time of flight of ink ejected for forming a first layer is longer than a time of flight of ink ejected for forming a last layer, or other subsequent layer.

Systems and methods are provided for correcting a positioning error in drop placement that would otherwise result and form an objectionable final image. In particular, when forming three dimensional structures for printing on moving media, such as Braille marking or lenticular lenses, product codes, etc., a number of layers that have already been printed may be recorded and/or determined, and a firing time of jets configured to eject ink for forming the ink images may be adjusted to compensate for the decreased flight times of the jets as layers become thicker during a print run. By adjusting a time of flight, position errors may be minimized. Systems and methods may be implemented for multi-pass systems as well as single-pass systems having many print heads. Accordingly, improved imaging may be realized for applications including printing Braille on currency with UV gel ink or other suitable marking material, creating lenticular lenses over images with UV gel ink, and forming three dimensional bar codes.

Typically, a print head of ink printing system, for example, ejects drops at a consistent firing frequency, at predetermined firing times. The drops may be ejected on a substrate in a line, laid down at even time intervals. Assuming that a speed or velocity of media passing the print head is constant, times of firing or ejecting ink from the print head are equally spaced in time. Therefore, a media speed, desired drop spacing, and ejection rate for a given velocity may be determined for creating a desired line of ink. For forming a three dimensional image on a substrate such as paper media, for example, a pile height may be gained by accumulating successive drops of ink at a particular location, i.e. at target location, passing the substrate under a print head multiple times, passing the substrates under multiple print heads, or a combination of both. After a first ink layer is formed on the substrate at a target location, and as subsequent passes under the print head or a different print head occur, a distance between a print head and target surface becomes smaller after each successive ink layer is formed at the target location. In absence of any correction, a print head may fire at a target from further away, resulting in drops landing sooner than anticipated on the substrate surface, a distance from or displaced from the target location. The result would be a cumulative position error in drop placement on the substrate that, if uncorrected, would result in a final three dimensional printed ink structure or image that would not appear as intended.

By knowing an approximate thickness of each layer of ink drop(s), an algorithm may be developed in accordance with disclosed methods to set an appropriate time delay or advance, or change in jet firing frequency may be effected by a systems for one or more print heads, and/or one or more jets of the one or more print heads, thereby compensating for changes in distance between the ejecting print head and a target location.

FIG. 1 shows a system for printing three dimensional ink images on the substrate in accordance with an exemplary embodiment. In particular, FIG. 1 shows a diagrammatical view of a three dimensional ink image printing system. The three dimensional ink image printing system is configured to eject ink onto a substrate 101, and particularly a surface thereof. The ink may be ejected from a print head 111 onto media to form a three dimensional ink structure 117 on the substrate 101 surface.

The print head 111 may be configured to eject ink droplets 121 at a predetermined velocity V1. The predetermined velocity V1 is a jet velocity of ink ejected from print head 111. The substrate 101 is configured to pass the print head 111 at a predetermined velocity V2, or a media velocity in a process direction. During a print run, the print head 111 may be caused to eject ink droplets 121 onto a surface of the substrate 101 to form a first ink layer at a target location. The distance between the first layer formed by the ink jetted by the print head 111 on the substrate 101 surface and the print head 111 may be a first distance D1. The substrate 101 may be configured to pass the print head 111 multiple times, each successive time receiving ink ejected by the print head 111 for forming the three dimensional ink structure 117. Another ink layer formed by ejected ink 121 may be received in each pass of the substrate 101 by the print head 111 in a recirculating media path configuration, or subsequent print heads arranged along a media transport path. A distance between subsequent layers of the three dimensional structure 117 and the print head 111 may be smaller than the first distance D1. For example, the distance D2 between the multi-pass three dimensional ink structure 117 shown in FIG. 1 and the print head 111 shown in FIG. 1 is less than the distance D1 between the first ink layer formed by the ejected ink 121 and the print head 111.

Figure 2:
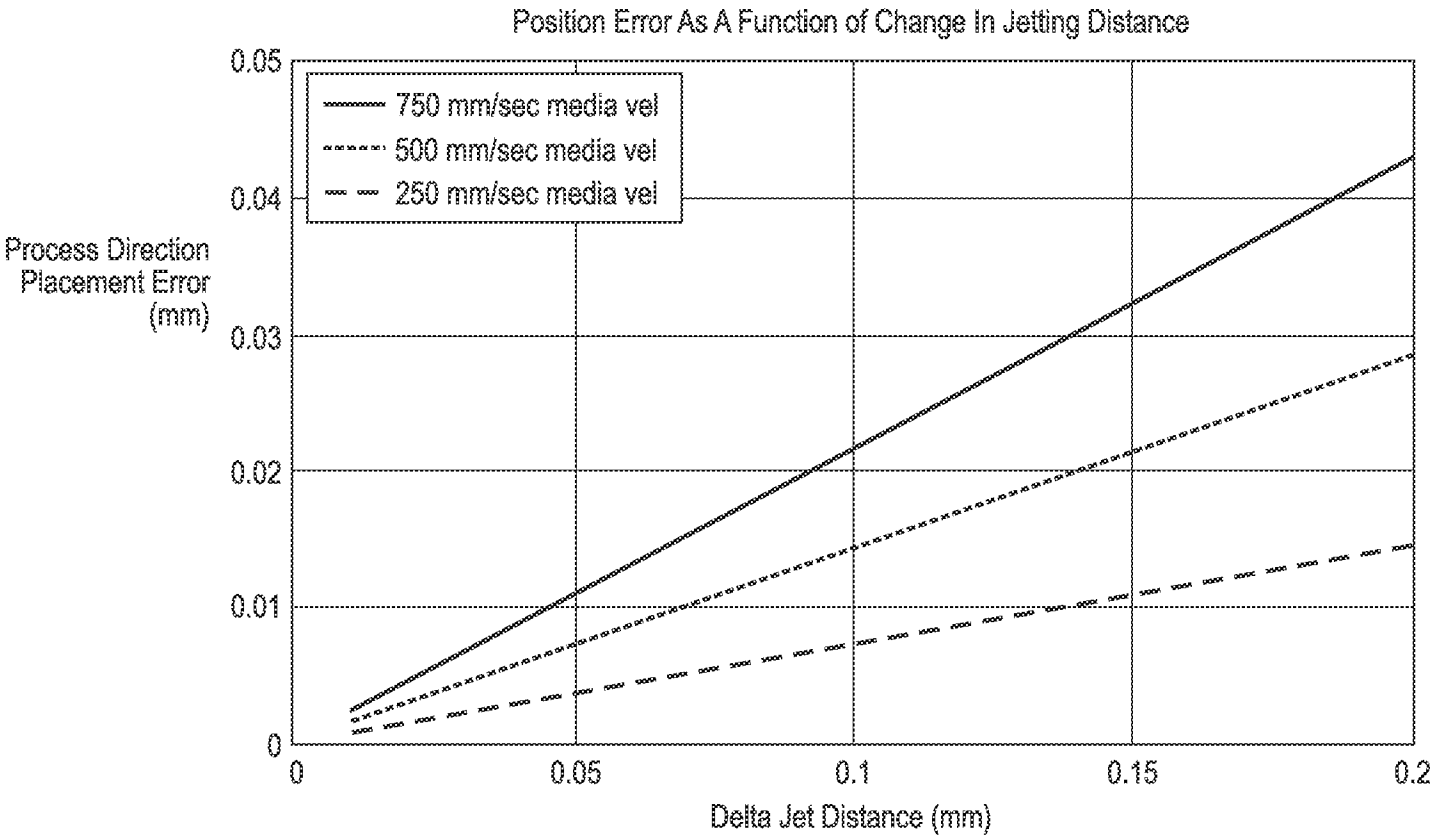
FIG. 2 shows a graph depicting position error as a function of change in jetting distance.

FIG. 2 shows a graph depicting position error as a function of change in jetting distance. In particular, FIG. 2 shows that as a distance between a jet of a print head and passing media changes, so does process direction placement error. In particular, FIG. 2 shows changing jet distance in millimeters and a process direction placement error in millimeters. FIG. 2 shows that as jet distance change increases, process direction placement error also increases. In accordance with methods, and knowing an approximate thickness of each layer of drops, an algorithm may be constructed to set an appropriate timed layer advance may be effected for each jet, thereby compensating for the changes in distance.

Figure 3:
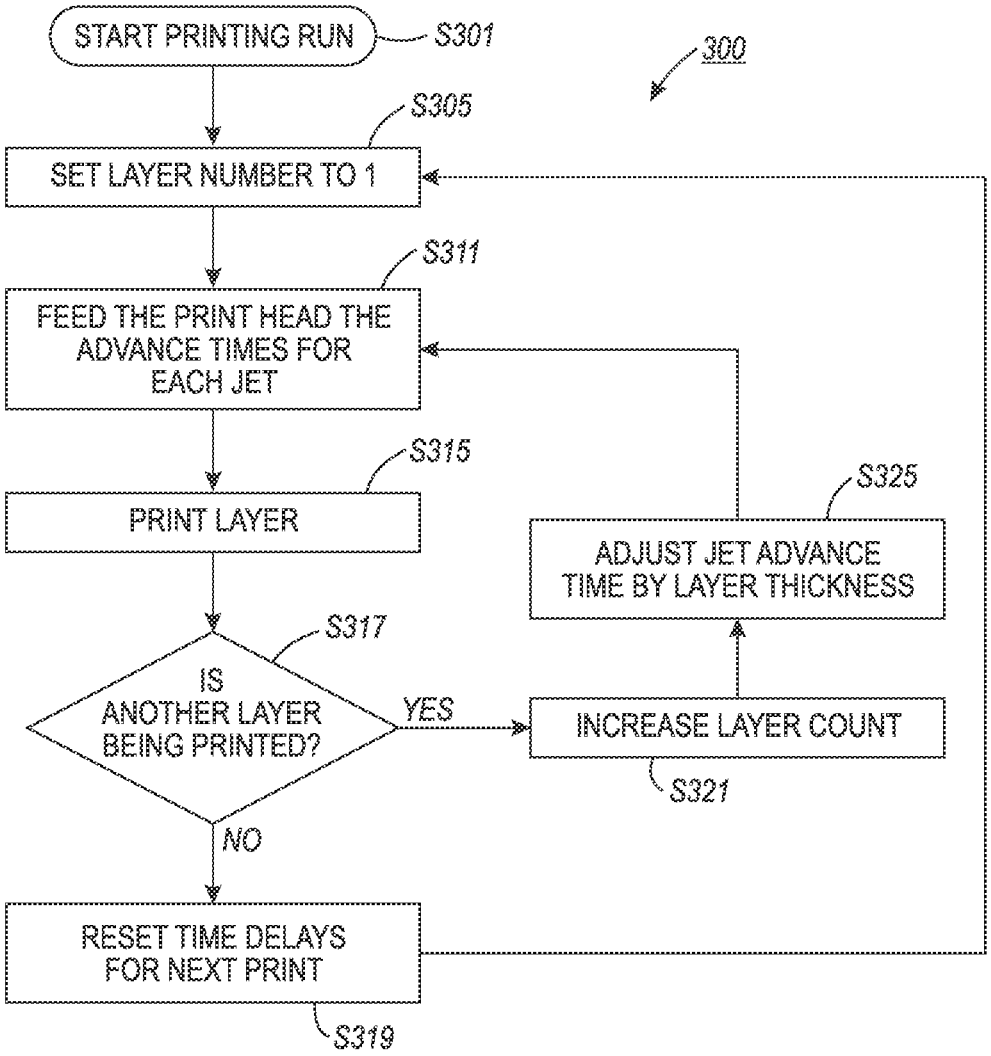
FIG. 3 shows a graph depicting shows methods for printing raised marks on a moving substrate in accordance with an exemplary embodiment.

For example, FIG. 3 shows methods in accordance with an exemplary embodiment. Printing systems may be configured and implemented to carry out a printing n accordance with methods. In particular, FIG. 3 shows a three dimensional ink image printing process 300 wherein a print run is started at S301. At S305, a layer number is set to 1. As such, the system may be configured for printing a first layer. At S311, advance times or firing time adjustments may be fed to the print head for each print jet of the print head for adjusting a time interval between ejections, a frequency of ejections of ink onto a substrate, and/or a firing time of a jet with respect to predetermined time such as a print run start time, or preferably, a detection of a lead edge of a media sheet or other substrate. For example, the print head may include a time advance/delay buffer for receiving advance times and/or delay time values. Methods may include printing a layer at S315. At S317, methods may include determining whether another layer is to be printed. If another layer is to be printed, the layer count may be increased at S321. The advance time may be calculated by adjusting for layer thickness in view of the increase in layer count at S325. For example, a processor may calculate a time advance/delay based on the increase layer count at S321. The calculated value may be fed to the print head at S311, and a subsequent layer may be printed at S315.

If it is determined that another layer is not to be printed at S317, time delays for feeding to the print head may be reset for a next print run at S319, and the layer number reset to 1 at S305.

Figure 4:
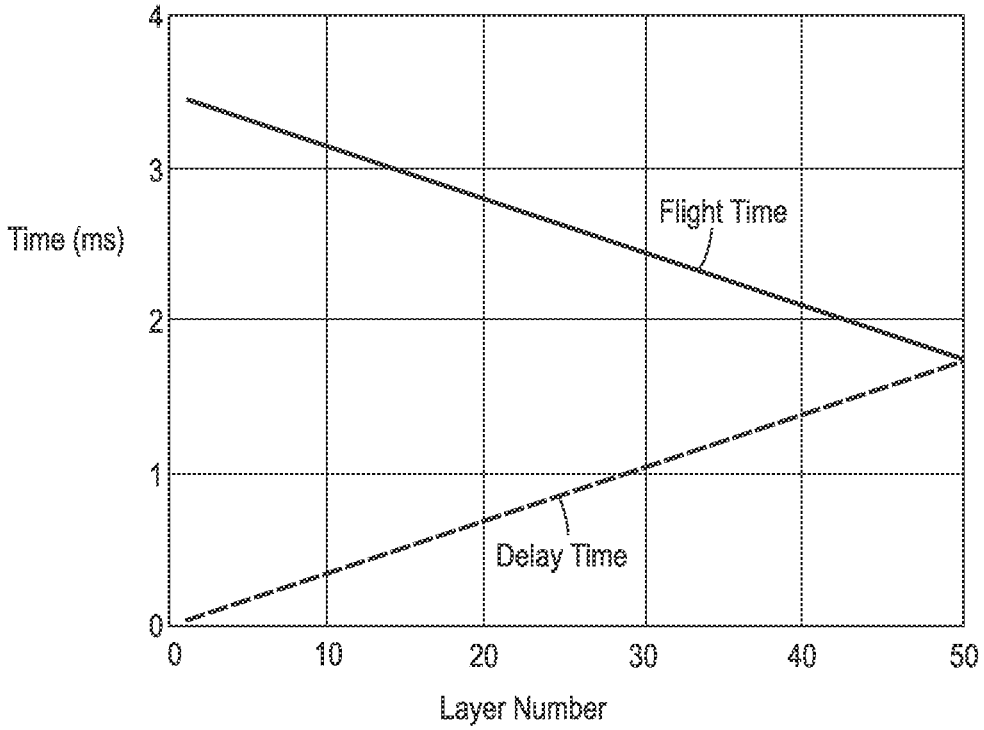
FIG. 4 shows a graph depicting flight time and delay of firing time as a function of a number of layers applied to a substrate.

For each layer of thickness, a jet firing time may be advanced by the thickness of the previous layer and a velocity of a media, which is predetermined. A sample time advance calculation for 150 inches per second media speed may be as follows:

Layer thickness=10 mic.
Media velocity=100 in. per sec.
Media velocity=500 ft. per min.
Jet velocity=3.5 m. per sec.
Nominal distance=1 mm
V=D/T
Time delay (layer)=layer×layer thickness×jet velocity
Flight time (layer)=(nominal distance×jet velocity)−layer thickness×jet velocity FIG. 4 shows that as an ink layer becomes thicker during subsequent passes of a substrate by a print head, a contribution in time shift becomes substantial as a percentage of flight time of an ink droplet ejected from a print head during a print run. FIG. 4 shows a number of layers applied to a substrate over time.

There are multiple possible printing configurations. For example, a system may be configured to produce a printed structured image by printing 50 layers of marking material on a substrate by causing the substrate to pass under a print head 50 times using a recirculating path. Alternatively, a plurality of heads such as 10 print heads may be used and the print recirculated 5 times, in which case the above-discussed methods may be modified in the spirit of the disclosed embodiment and/or to keep track of a number of layers applied by each print head. In another embodiment, 40 or 50 print heads may be implemented with no recirculation of media, and with a mechanical offset. Systems and methods may be configured to deposit a layer of marking material on the substrate during a first pass of the substrate by a print head and also to deposit a layer during each pass of the substrate by a print head thereafter. Alternatively, systems and methods may be configured for depositing a layer on a substrate during specific passes of a substrate by a print head, wherein the substrate does not receive a deposit of ink on every pass of the substrate by a print head. For example, systems and methods may be configured to deposit ink on a substrate 1 out of 4 times that the substrate passes a print head along a media transport pathway.

In systems and methods disclosed, processes may be configured to account for known interactions between media and ink, and resulting minor differences in average layer thicknesses. An operator may enter a nominal thickness or use a look-up table for media, for example, and methods as disclosed may be modified and configured for calculating changes in firing time based on differences in layer thickness for successive ink layers formed on a target location of a substrate surface of a substrate passing a print head in a print run for printing raised markings.

Systems for implementing methods may include a time advance/delay buffer located in a print head, one or more controllers or processors, and a computer readable medium on which is recorded methods including those discussed above for raised mark printing drop placement error correction.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable processing means by which to carry into effect the apparatus, systems, and methods for familiarity and ease of understanding. Although not required, elements of the disclosed exemplary embodiments may be provided, at least in part, in a form of hardware circuits, firmware, or software computer-executable instructions to carry out the specific functions described. These may include individual program modules executed by one or more processors. Generally, program modules include routine programs, objects, components, data structures, and the like that perform particular tasks, or implement particular data types, in support of the overall objective of the systems and methods according to this disclosure.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A system for controlling printing of raised markings on a flat substrate to form a pattern, comprising:

at least one marking material ejecting device configured to eject marking material a first distance onto a flat surface of the flat substrate moving at a predetermined velocity, wherein a first layer of marking material is formed at a target location on the flat substrate surface by marking material ejected by the marking material ejecting device at a first firing time upon a pass of the marking material ejecting device over the target location, and wherein a second layer of marking material is formed at the target location by marking material ejected by the marking material ejecting device a second distance less than the first distance onto the target location at a second firing time upon a subsequent pass of the marking material ejecting device over the target location, the at least one marking material ejecting device being connected to a controller, the controller being configured to cause the at least one marking material ejecting device to form at least the first layer and the second layer at the target location on the flat substrate to form a lenticular structure, braille, two dimensional bar code, or security encoding; and a processor configured to calculate a firing time value, wherein the at least one marking material ejecting device is configured to form the first layer, the second layer, and successive layers at the target location on the flat substrate by ejecting marking material at a respective firing time, the at least one marking material ejecting device comprising a time advance/delay buffer configured to receive the firing time value calculated by the processor based on a thickness of a layer of marking material previously formed at the target location on the flat substrate and a number of marking material layers previously ejected onto the flat surface at the location of the flat substrate, and a third distance between the at least one marking material ejecting device and the flat surface of the flat substrate remains the same regardless of a distance between the first distance and the second distance.

2. The system of claim 1, the marking material ejecting device further comprising an ink jet print head.

3. The system of claim 2, the print head comprising at least one ink jet.

4. The system of claim 1, comprising a plurality of ink ejecting devices configured to eject ink on the flat substrate surface.

5. The system of claim 1, the firing time being an elapsed time from a flat substrate lead edge detection time.

6. The system of claim 1, the marking material ejecting device being configured to eject radiation-curable gel ink.

7. The system of claim 1, whereby the second layer is formed on the first layer.

8. The system of claim 1, the marking material ejecting device having a print head, wherein the second layer is formed a distance from the print head that is less than a distance between the print head and the first layer.

9. The system of claim 1, the at least one marking material ejecting device comprising a first print head and a second print head, wherein the first print head forms the first layer and the second print head forms the second layer at the location on the flat substrate.

10. The system of claim 1, further comprising:

a recirculating media transport system being configured to cause the flat substrate to pass the at least one marking material ejecting device a plurality of times at a predetermined velocity.

11. The system of claim 1, wherein the at least one marking material ejecting device is configured to form the successive layers of the marking material only during specific passes over the flat substrate, the specific passes being less than a number of total passes over the flat substrate, wherein the flat substrate does not receive a deposit of the marking material on every pass of the flat substrate by the at least one marking material ejecting device.

12. A method for controlling printing of raised markings on a flat substrate to form a pattern, comprising:

causing a print head to eject marking material a first distance onto a flat surface of the flat substrate at a target location to form a first marking material layer at the target location, the marking material being ejected at a first firing time;

causing one of the print head or a second print head to eject marking material a second distance less than the first distance onto the target location to form a second marking material layer at the target location of the flat substrate, the marking material being ejected at a second firing time upon a subsequent pass of the one of the print head or second print head over the target location, the second firing time being based on a time delay value received by a time delay buffer at the print head, the print head and second print head being connected to a controller, the controller being configured to cause the print head and second print head to form at least the first layer and the second layer at the target location on the flat substrate to form a lenticular structure, braille, two dimensional bar code, or security encoding, wherein a third distance between the one of the print head or the second print head and the flat surface of the flat substrate when the one of the print head or the second print head ejects the marking material remains the same regardless of a distance between the first distance and the second distance;

calculating, with a processor, the time delay value based on at least one of a deposited marking material layer thickness and a number of marking material layers previously applied to the flat surface of the flat substrate at the target location;

feeding the calculated time delay value to the time delay buffer.

13. The method of claim 12, wherein the second layer is formed on the first layer.

14. The method of claim 12, comprising the firing time being a time at which the print head ejects marking material with respect to a detection of a lead edge of the flat substrate.

15. The method of claim 12, further comprising causing the one of the print head or the second print head to eject marking material onto the flat surface of the flat substrate at the target location to form successive marking material layers at the target location only during specific passes over the flat substrate, the specific passes being less than a number of total passes over the flat substrate, wherein the flat substrate does not receive a deposit of the marking material on every pass of the flat substrate by the print head.

16. A method for controlling printing of raised markings on a flat substrate to form a pattern, comprising:

causing a print head to eject marking material a first distance onto a flat surface of the flat substrate at a target location to form a first marking material layer at the target location. the marking material being ejected at a first firing time:

causing one of the print head or a second print head to eject marking material a second distance less than the first distance onto the target location to form a second marking material layer at the target location of the flat substrate, the marking material being ejected at a second firing time, the second firing time being based on a time delay value received by a time delay buffer at the print head. the print head and second print head being connected to a controller, the controller being configured to cause the print head and second print head to form at least the first layer and the second layer at the target location on the flat substrate to form a lenticular structure, braille, two dimensional bar code, or security encoding, wherein a third distance between the one of the print head or the second print head and the flat surface of the flat substrate when the one of the print head or the second print head ejects the marking material remains the same regardless of a difference between the first distance and the second distance, calculating, with a processor, the time delay value based on at least one of a deposited marking material layer thickness and a number of marking material layers previously applied to the flat surface of the flat substrate at the target location, feeding the calculated time delay value to the time delay buffer:

wherein the step of causing the one of the print head or the second print head to eject marking material onto the flat surface of the flat substrate at the target location to form a second marking material layer at the target location of the flat substrate includes forming the second marking material layer on the first marking material layer, and causing the one of the print head or the second print head to eject marking material onto the flat surface of the flat substrate at the target location to form successive marking material layers at the target location upon successive passes of the one of the print head or the second print head over the target location.

* * * * *